US005873556A

United States Patent [19]

Reiker

[11] Patent Number: 5,873,556

[45] Date of Patent: Feb. 23, 1999

[54] ADJUSTABLE DROP CEILING FIXTURE SUPPORT

[76] Inventor: Kenneth H. Reiker, 4106 P.O. Box, Shalimar, Fla. 32579

[21] Appl. No.: 403,266

[22] Filed: Mar. 13, 1995

[51] Int. Cl.[6] ..... B42F 13/00

[52] U.S. Cl. ..... 248/323; 248/333; 248/343; 248/906

[58] Field of Search ..... 248/342, 343, 248/344, 228.2, 228.1, 274.1, 201, 287, 333, 323, 317, 906, 59, 327; 52/39; 362/406, 430, 418

[56] References Cited

U.S. PATENT DOCUMENTS

| | | | |
|---|---|---|---|
| Re. 33,147 | 1/1990 | Reiker | 248/200.1 |
| D. 288,289 | 2/1987 | Reiker . | |
| 1,786,004 | 12/1930 | Clayton . | |
| 2,178,168 | 10/1939 | Gibson . | |
| 2,670,917 | 3/1954 | Hoffman | 248/342 X |
| 2,962,252 | 11/1960 | Frank . | |
| 3,104,087 | 9/1963 | Budnick et al. . | |
| 3,312,434 | 4/1967 | Simon | 248/333 X |
| 3,312,816 | 4/1967 | Muller et al. . | |
| 4,041,657 | 8/1977 | Schuplin | 248/343 X |
| 4,127,252 | 11/1978 | Splawn | 248/333 |
| 4,149,693 | 4/1979 | LoNigro . | |
| 4,463,923 | 8/1984 | Reiker . | |
| 4,518,141 | 5/1985 | Parkin | 248/906 X |
| 4,645,158 | 2/1987 | Manning | 248/906 X |
| 4,684,092 | 8/1987 | Reiker | 248/200.1 |
| 4,717,099 | 1/1988 | Hubbard . | |
| 5,044,582 | 9/1991 | Walters | 248/343 X |
| 5,085,392 | 2/1992 | Perna . | |
| 5,085,393 | 2/1992 | Ryan . | |
| 5,221,064 | 6/1993 | Hodges | 248/333 X |
| 5,303,894 | 4/1994 | Deschamps et al. | 248/343 |

OTHER PUBLICATIONS

Erico Products Catalog, "Caddy Wedge Hangers", 1973, p. 12.

*Primary Examiner*—Derek J. Berger
*Attorney, Agent, or Firm*—Shlesinger, Arkwright & Garvey LLP

[57] ABSTRACT

A ceiling fixture hangar having an adjustable elongated first support and an adjustable elongated second support. Each of the first and second supports have first and second ends. Each of the ends of the first support is securable to a ceiling joist. The first end of the second support is slidably connected between the two ends of the first support. A mounting plate is secured to the second end of the second support which is adapted to receive a fixture.

39 Claims, 4 Drawing Sheets

ADJUSTABLE DROP CEILING FIXTURE SUPPORT

FIELD OF THE INVENTION

The present invention relates generally to a fixture mounting assembly. In particular, the invention is directed to a fixture support assembly which is horizontally and vertically adjustable and which is particularly suited for installation in a suspended or drop ceiling.

BACKGROUND OF THE INVENTION

Conventional supports are known for mounting fixtures to a standard ceiling during construction as well as retrofit installations in existing structures.

However, in today's energy conscious society many buildings are being built or renovated with drop ceilings to reduce heating and cooling costs as well as to reduce noise. These drop ceilings are installed in a variety of ceiling beam configurations, including I-beam, T-beam and tubular beam joists.

In addition, not only are fixtures, such as chandeliers and ceiling fans becoming heavier than prior art fixtures, but building codes are becoming more strict. Thus, there is a need for a fixture mounting assembly which can be readily and securely installed into a drop ceiling and yet carry relatively high static loads such as a chandelier and dynamic loads such as a ceiling fan.

There is likewise a need for a fixture mounting assembly which can be used for new construction as well as for retrofit installations which is easier to operate, stronger, and more stable than existing devices.

OBJECTS AND SUMMARY OF THE INVENTION

It is therefore an object of the present invention to provide a mounting assembly which can be readily and securely installed in a drop ceiling.

It is another object of the present invention to provide a mounting assembly which is suited for use in new construction and renovation as well as for retrofitting existing drop ceilings.

It is another object of the present invention to provide a mounting assembly configured to reduce torque and to transfer large static and dynamic loads to the ceiling joists in which the mounting assembly is installed.

It is yet another object of the present invention to provide a mounting assembly which utilizes the strength of the ceiling joists in which the mounting assembly is installed for carrying the load of a fixture attached to the mounting assembly.

It is still another object of the present invention to provide a mounting assembly with a vertical support member which can be easily adjusted to accommodate for a variety of distances between the ceiling joists and the drop ceiling.

It is yet another object of the present invention to provide a mounting assembly with a horizontal support member which can be easily adjusted to accommodate for a variety of distances between a pair of ceiling joists.

It is an object of the present invention to provide a mounting assembly which is strong enough to allow the vertical support member to be mounted anywhere along the horizontal support member.

It is still further another object of the present invention to provide a mounting assembly which can be inexpensively manufactured.

It is another object of the present invention to provide a mounting assembly which is resistant to oxidation and rusting.

It is yet a further object of the invention to provide a mounting assembly which is stronger than known devices.

In summary, the present invention is directed to a mounting assembly which can support relatively heavy loads, and which is horizontally and vertically adjustable to be readily and securely installed in a drop ceiling.

BRIEF DESCRIPTIONS OF THE DRAWINGS

These and other objects, advantages and novel features of the present invention will become apparent from the following detailed description taken in consideration of the accompanying drawings, in which.

DETAILED DESCRIPTION OF THE INVENTION

Figures 1, 2:
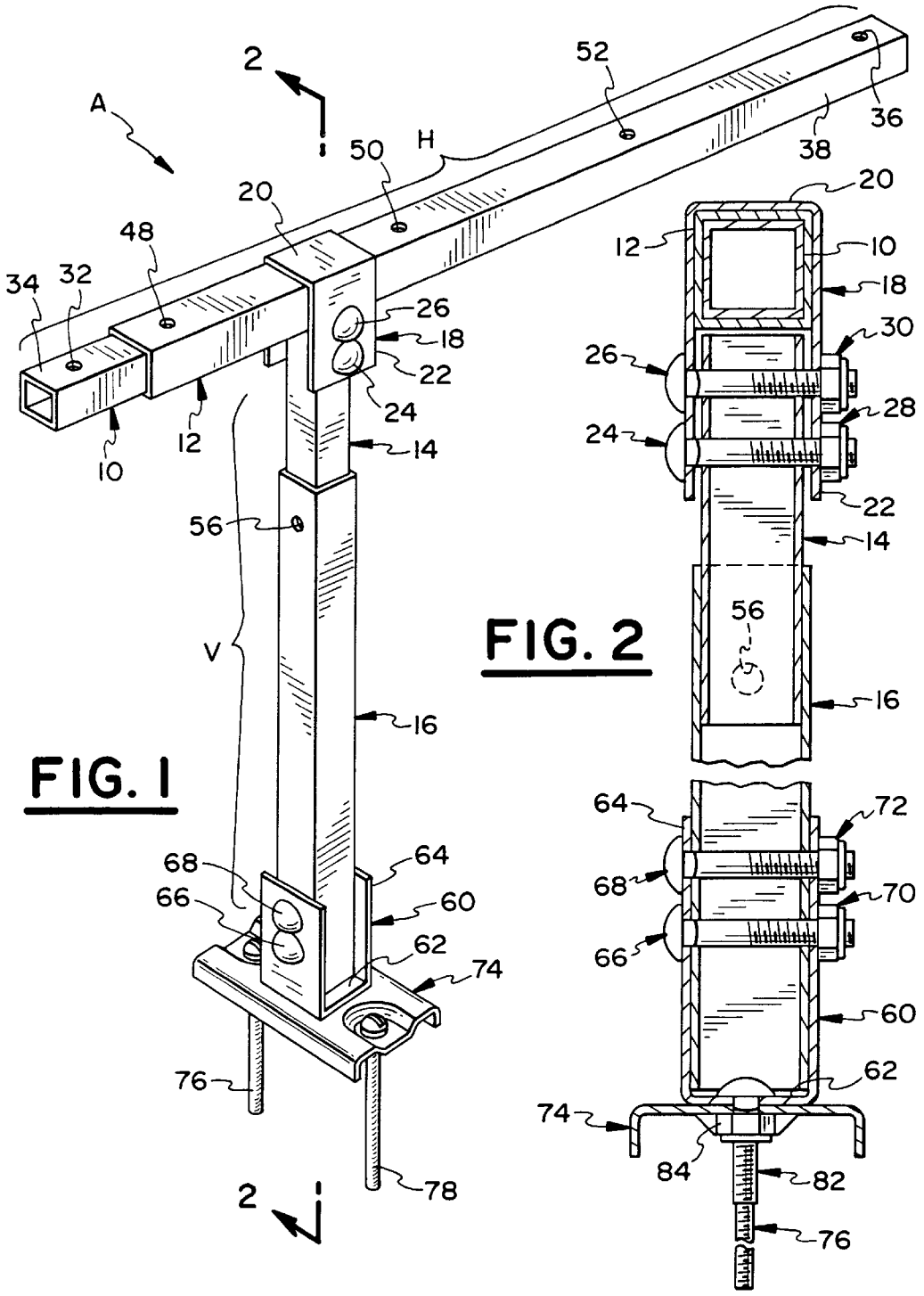
FIG. 1 is a perspective view of a mounting assembly according to the present invention.
FIG. 2 is a partial sectional view taken along line 2—2 of FIG. 1 with the bottom portion rotated 90 degrees for convenience of viewing.
Figure 3:
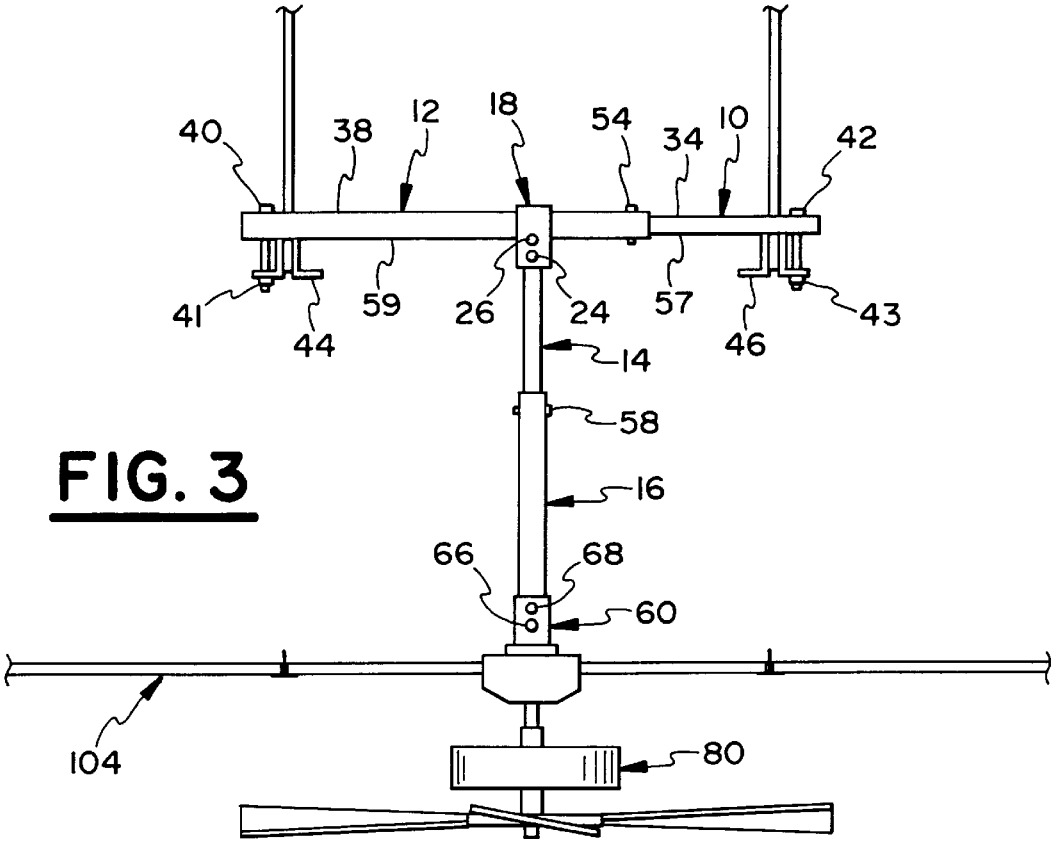
FIG. 3 is a side elevational view of a mounting assembly according to the present invention shown secured to a pair of joists and supporting a ceiling fan.

In the accompanying drawings, FIGS. 1–3 illustrate a preferred embodiment of mounting assembly A of the present invention.

Mounting assembly A includes a first or horizontal support member designated as H and a second or vertical support member designated as V. Horizontal support member H and vertical support member V may be made of rigid, corrosion resistant material such as stainless steel, to support heavy loads such as a chandelier or ceiling fan and to help resist torque.

Horizontal support member H includes a first or inner member 10 and a second or outer member 12 both of which are generally tubular in construction. Preferably, inner member 10 is positioned coaxially within outer member 12 and is slidable relative to outer member 12 prior to final installation. This slidability allows the length of horizontal member H to be varied according to the distance between two ceiling joists, for example.

Vertical support member V includes an inner member 14 and an outer member 16, both of which may be generally tubular in construction. Preferably, inner member 14 is positioned coaxially within outer member 16 and is slidable relative to outer member 16 prior to final installation. This allows the length of vertical member V to be varied according to the distance between the ceiling joists and the drop ceiling.

Vertical member V is connected transversely, and, preferably, generally perpendicular to horizontal member H by a bracket 18. Bracket 18 is generally U-shaped with a closed end portion 20 and an open end portion 22. Horizontal member H extends through closed end portion 20 with vertical member V inserted into the open end portion 22.

As best shown in FIGS. 1 and 2, bracket 18 is secured to vertical member V by bolts 24 and 26 which extend through open end portion 22 of bracket 18 and through inner member 14 of vertical member V. Bolts 24 and 26 are secured therein by nuts 28 and 30 respectively.

Prior to tightening nuts 28 and 30, bracket 18 and vertical member V can be positioned anywhere along horizontal member H to accommodate the proper positioning of the fixture to be mounted.

As best shown in FIG. 2, when nuts 28 and 30 are tightened, bolts 24 and 26 secure end portion 20 of bracket 18 around horizontal member H and secure bracket 18 to vertical member V. This prevents further movement of bracket 18 and vertical member V along horizontal member H.

As can best be seen in FIGS. 1 and 3–6, a hole 32 in the top surface 34 of inner member 10 and a hole 36 in the top surface 38 of outer member 12 are provided for receiving bolts 40 and 42 which are used to secure mounting assembly A to joists 44 and 46.

Holes 48, 50 and 52 in the top surface 38 of outer member 12 are provided such that when the desired length of horizontal member H has been determined, one or more of holes 48, 50 or 52 can be used as a template for drilling a hole through inner member 10. A bolt 54 (See FIG. 4) can then be inserted therein to prevent the movement of inner member 10 with respect to outer member 12.

Inner member 10 and outer member 12 each may have generally planar bottom surfaces 57 and 59 respectively (See FIG. 3). Surfaces 57 and 59 are to be placed in contact with the joists when mounting assembly A is installed. This helps transfer the weight of the object to be mounted to the joists. This also increases the stability of the mounted object by reducing any torque exerted on mounting assembly A.

While vertical member V and horizontal member H are shown to be generally rectangular in cross section, it is contemplated to be within the scope of the present invention that other shapes which give the needed support and which reduce torque can be used.

Figure 4:
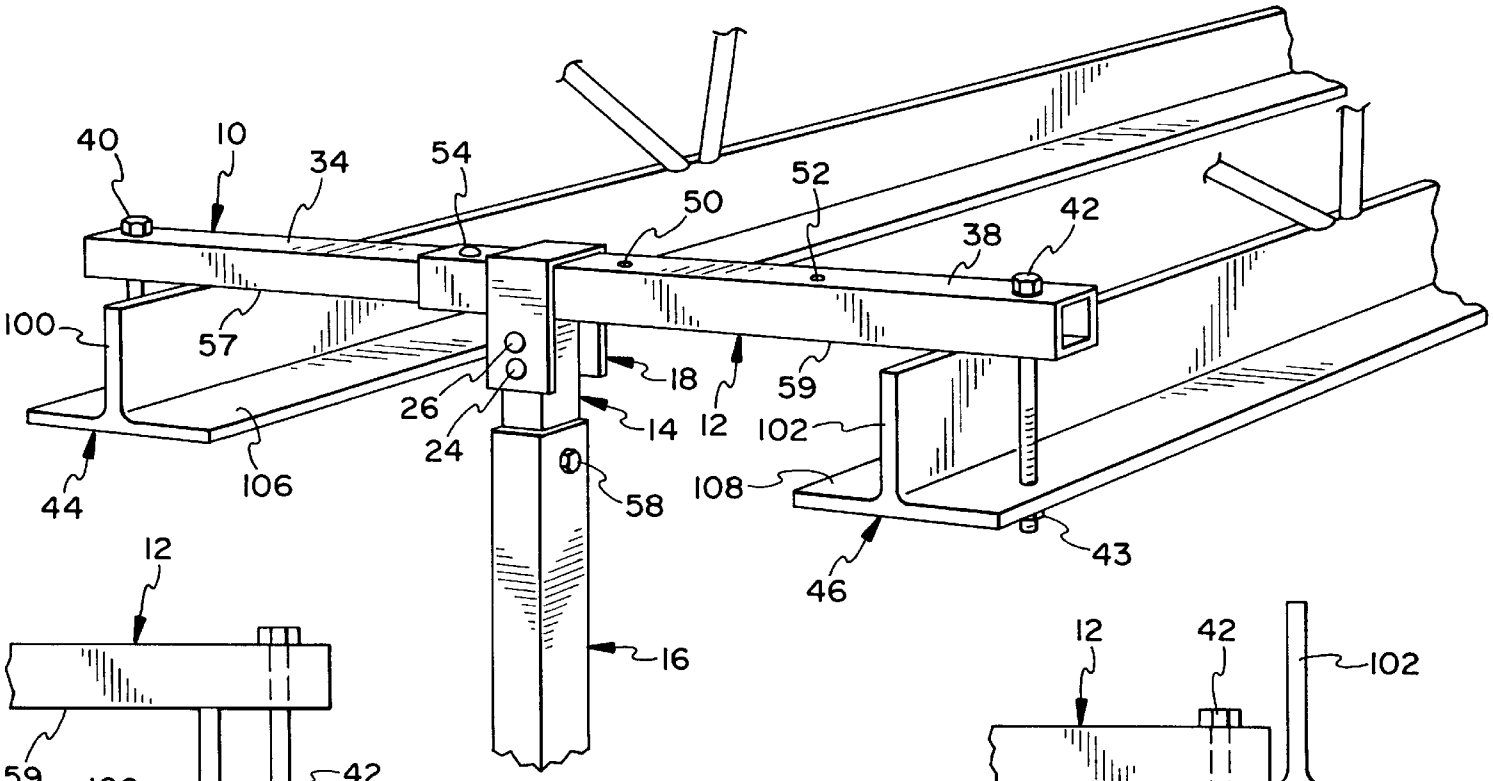
FIG. 4 is a partial perspective view of a mounting assembly according to the present invention shown secured to a pair of T-beam joists.

As best shown in FIGS. 1,2 and 4, hole 56 in outer member 16 of vertical member V is provided such that when the desired length of vertical member V has been determined, hole 56 can be used as a template for drilling a hole through inner member 14 for a bolt 58 (See FIG. 4) to be inserted therein. This prevents the movement of inner member 14 with respect to outer member 16 and maintains the desired length of vertical member V. Likewise, the use of hole 56 as a template provides the exact desired length (i.e., provides infinite adjustability). Still further, by use of hole 56 as a template, only one hole need be provided in inner member 14 when installed.

A second bracket 60 is connected at an end of vertical member V, opposite bracket 18. Bracket 60 is generally U-shaped with a closed end portion 62 and a open end portion 64. Outer member 16 is inserted into open end portion 64 and is transverse, and preferably generally perpendicular to closed end portion 62.

Bolts 66 and 68 extend through open end portion 64 and through outer member 16 and are secured therein by nuts 70 and 72 respectively. When nuts 70 and 72 are tightened, bolts 66 and 68 secure bracket 60 to outer member 16.

A fixture mounting plate 74 is provided with attachment members such as bolts 76 and 78 which enables the mounting of a fixture such as a ceiling fan 80 (See FIG. 3) to mounting assembly A. Plate 74 is secured to bracket 60 by a bolt 82 and a nut 84. Bolt 82 extends through closed end portion 62 of bracket 60 and through mounting plate 74 with nut 84 securing bracket 60 thereon.

OPERATION

As shown in FIGS. 4–9, mounting assembly A can be readily secured to various types of ceiling joists.

Figure 5:
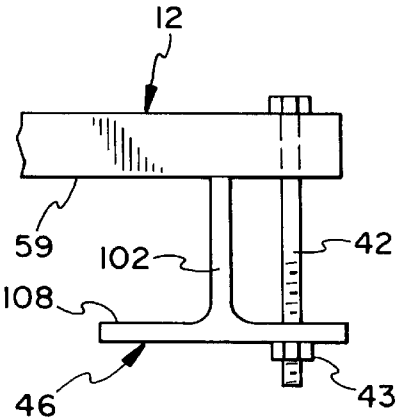
FIG. 5 is a partial side elevational view of one end of the mounting assembly secured to a T-beam joist as shown in FIG. 4.

FIGS. 3–5 illustrate a preferred method of securing mounting assembly A to a pair of spaced apart T-beam joists.

To determine the proper length required for installation of horizontal member H, horizontal member H is placed on top of T-beams 44 and 46 and is adjusted until holes 32 and 36 extend beyond vertical members 100 and 102 of T-beams 44 and 46. Bottom surfaces 57 and 59 should be in contact with vertical members 100 and 102. This will ensure the determining of the desired length. Likewise, the contacting of bottom surfaces 57 and 59 will ensure the even transfer of the weight of the mounted object to the joists as well as reduce any torque created by an object such as a ceiling fan when installation is complete.

When the desired length of horizontal support H is determined, a hole is drilled through inner member 10 using one of holes 48, 50 or 52 as a template. Bolt 54 is then inserted through the hole which secures inner member 10 to outer member 12 and prevents any movement and unintended variation of the length of horizontal member H.

Similarly inner member 14 of vertical support V is adjusted to a desired length for which to mount the object. Once the length is determined, a hole is drilled through inner member 14 using hole 56 as a template. Bolt 58 is then inserted through hole 56 and inner member 14 and secures inner member 14 to outer member 16 thereby preventing any vertical movement or adjustment of the length of vertical member V.

Mounting plate 74 is then attached to closed end portion 62 of bracket 60 by securing bolt 82 and nut 84 thereon (See FIGS. 1 and 2).

As shown in FIGS. 1–3, bracket 18 is then placed around horizontal member H. Inner member 14 of vertical member V is inserted into the open end portion 22 of bracket 18. Bolts 24 and 26 are inserted through bracket 18 to hold vertical member V and bracket 18 together. Bracket 18 is then positioned at the desired location on horizontal member H, aligning vertical member V at the desired position relative to the ceiling tiles (See FIG. 3).

Vertical member V is then secured to bracket 18 and horizontal member H by securing bolts 24 and 26 with nuts 28 and 30 respectively. This step also prevents bracket 18 and vertical member V from moving or shifting from the desired position along horizontal member H.

Horizontal member H is then placed over T-beams 44 and 46. Bottom surfaces 57 and 59 should be in contact with vertical member 100 and 102. This will ensure the transfer of the weight of the object to be mounted to the joists as well as reduce any torque created by the mounted object such as a ceiling fan.

Holes are then drilled in beams 44 and 46 in alignment with holes 32 and 36. Bolts 40 and 42 are then inserted through inner member 10 and outer member 14 respectively and through beams 44 and 46. Bolts 40 and 42 are then secured to beams 44 and 46 with nuts 41 and 43 (See FIGS. 3–5).

The object to be mounted, such as a chandelier or ceiling fan 80, is then secured to mounting plate 74 with bolts 76 and 78 (See FIGS. 1 and 3).

Figure 6:
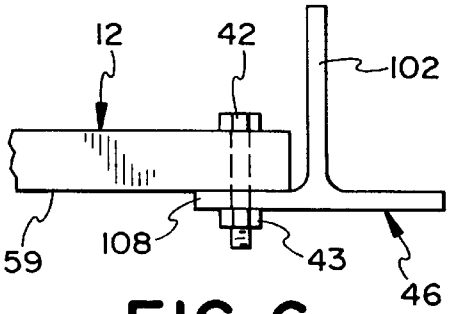
FIG. 6 is a partial side elevational similar to FIG. 5 showing an alternative arrangement for securing the assembly to a T-beam joist.

As shown in FIG. 6, an alternative preferred method of installing horizontal member H to the joist members can be used. This method is particularly useful when the joists are spaced too far apart such that horizontal member H cannot properly extend beyond vertical members 100 and 102 of joists 44 and 46 respectively.

Bottom surface 57 of inner member 10 and bottom surface 59 of outer member 12 are placed in contact with horizontal member 106 and 108 of T-beams 44 and 46, respectively, only the right side of which is shown in FIG. 6.

A hole is then drilled through horizontal members 106 and 108 using holes 32 and 36 as templates and bolts 40 and 42 are inserted therein. Mounting assembly A is then secured to joists 44 and 46 by securing nuts 41 and 43 onto bolts 40 and 42 respectively.

Figures 7, 8, 10:
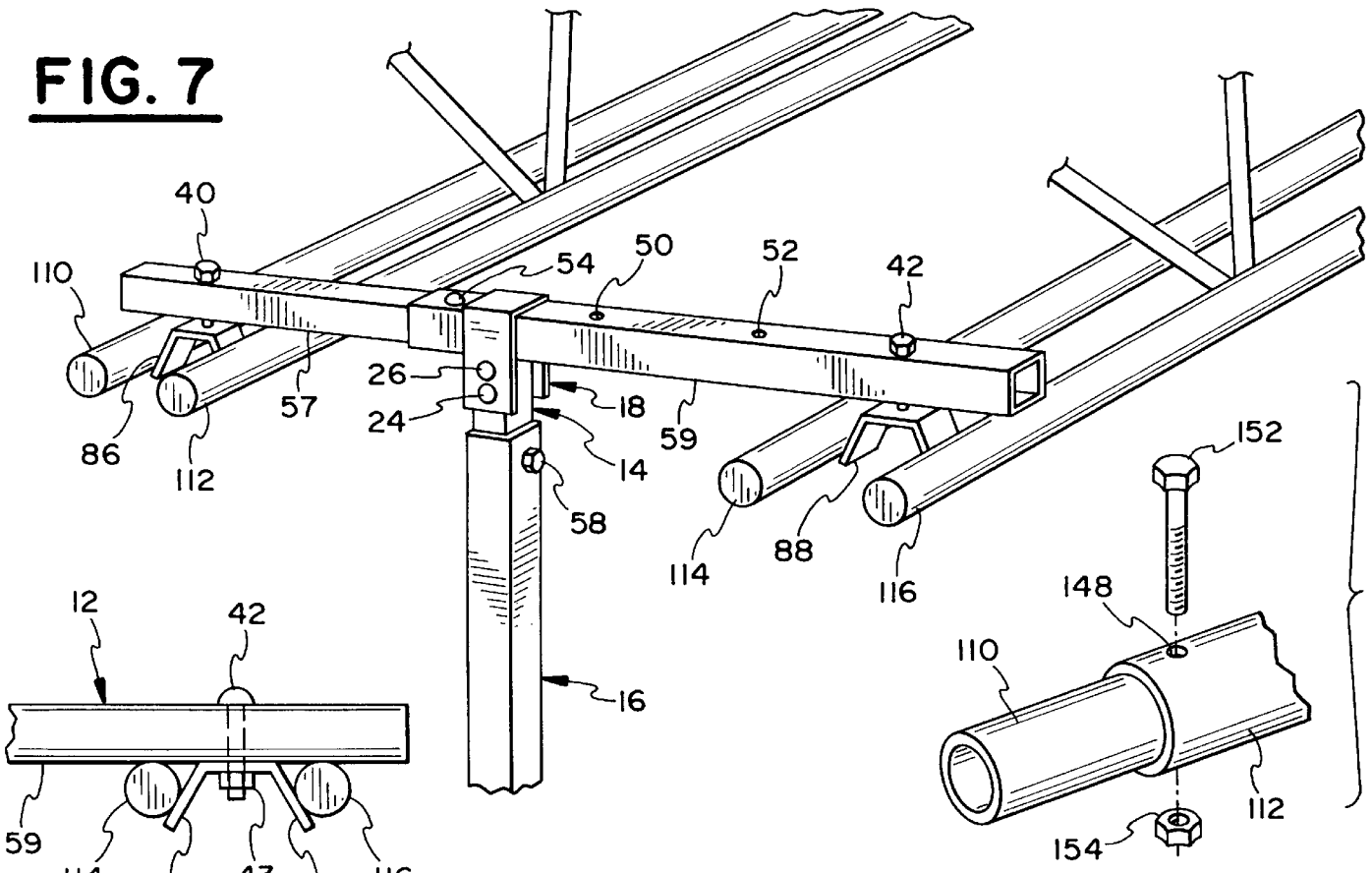
FIG. 7 is a partial perspective view similar to FIG. 4 showing the mounting assembly secured to tubular ceiling joists with wedge brackets.
FIG. 8 is a partial side elevational view of one end of the mounting assembly secured to tubular ceiling joists as shown in FIG. 7.
FIG. 10 is a partial side elevational view of a support assembly where the inner and outer members comprise circular tubes.

As shown in FIGS. 7–8, a further preferred alternative method of installing horizontal member H to joist members can be used. This is particularly useful when the joists are of the tubular type. The installation is virtually the same as described above with the exception of the mounting of horizontal member H to the joists.

In this embodiment, horizontal member H is adjusted to a length such that hole 32 is aligned between tubular joists 110 and 112 and hole 36 is aligned between tubular joists 114 and 116.

As shown in FIGS. 7 and 8, wedge brackets 86 and 88 are inserted below horizontal member H and between joists 110 and 112, and between joists 114 and 116 respectively. Wedge brackets 86 and 88 are then secured in place by bolts 40 and 42, and nuts 41 and 43, respectively.

Figure 9:
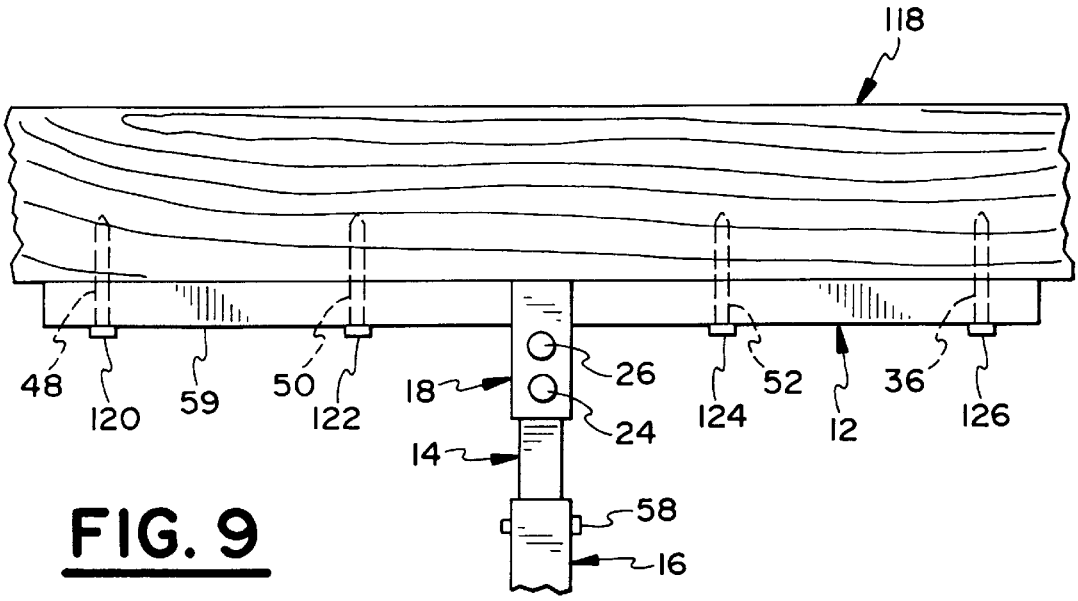
FIG. 9 is a partial side elevational view of the mounting assembly secured to a single wooden joist.

As shown in FIG. 9, a still further preferred Method of installing horizontal member H on a single wooden joist member can be used. Inner member 10 is removed from outer member 12. Outer member 12 is secured to wooden joist 118. Fasteners, such as screws 120, 122, 124 and 126 are inserted through holes 48, 50, 52, and 36 respectively and securely driven into wooden joist 118. The installation of the other components of Mounting assembly A is similar to that described above.

In all of the embodiments described above, stabilizer wires (not shown) can be secured to mounting bracket 74 and virtually any of the type of joist to give additional lateral stability to mounting assembly A. All the elements of the ceiling fixture support may be made of various shapes, configurations, and materials. For example, when horizontal and vertical support members are made of circular rods and/or tubing, as shown in FIG. 10, means for resisting torque may be provided in the form of holes 148 provided in paired, telescoping circular tubes 110, 112, through which a bolt 152 and nut 154, pin, rivet, grommet and the like extends for eliminating relative movement between the telescoping members and resisting torque.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A ceiling fixture hangar, comprising:

a) an elongated first support having first and second end portions;

b) said first support including a means for infinitely variably fixedly adjusting the length of said first support;

c) said first support including first and second members movable relative to each other for adjusting the length of said first support;

d) a template being provided on said first member for guiding a user to drill a hole in said second member;

e) an elongated second support having first and second end portions;

f) said second support including a means for infinitely variably fixedly adjusting the length of said second support;

g) means for fixedly connecting said first end portion of said second support to said first support intermediate said first and second end portions of said first support;

h) means disposed adjacent said first support for securing said first and second end portions of said first support with two spaced apart ceiling joists for supporting a vertical load; and i) means disposed adjacent said second support for mounting a fixture to said second end portion of said second support.

2. The hangar as recited in claim 1, wherein:

a) said connecting means includes a generally U-shaped bracket having an open end and a closed end;

b) said first support extends through said bracket, and said closed end of said bracket substantially engages said first support; and c) means disposed adjacent to said bracket for releasably fastening said open end of said first bracket to said first end portion of said second support.

3. The hangar as recited in claim 1, wherein:

a) said length adjusting means for said second support includes generally tubular inner and outer members; and b) said inner member is telescopically adjustable with respect to said outer member.

4. The hangar as recited in claim 3, wherein:

a) each of said inner and outer members have generally non-circular cross sections for resisting torque.

5. The hangar as recited in claim 3, further including:

a) means for securing said inner member to said outer member.

6. The hangar as recited in claim 1, wherein:

a) said first support includes a generally planar bottom surface for contacting a joist.

7. The hangar as recited in claim 1, wherein:

a) said securing means includes a bolt extending through each of said first and second end portions of said first support, and each of said bolts being securable to a ceiling joist.

8. The hangar as recited in claim 1, wherein:

a) said securing means includes a generally U-shaped wedge bracket removably attached to each of said first and second end portions of said first support member, and each of said wedge brackets being securable to a ceiling joist.

9. The hangar as recited in claim 1, wherein:

a) said length adjusting means for said first support includes substantially circular inner outer members;

b) said inner member is movable relative to said outer member; and, c) means is provided for resisting torque between said inner member said outer member.

10. The hangar as recited in clam 9, wherein:

a) said substantially circular inner and outer members include circular tubing; and, b) said means for resisting torque includes a hole provided in each said inner and outer member, and a locking element disposed in said holes for resisting relative movement therebetween.

11. The hangar as recited in claim 1, wherein:

a) said first support includes substantially circular inner and outer members;

b) said inner member is movable relative to said outer member; and, c) an element is provided for resisting torque between said inner member and said outer member.

12. The hangar as recited in claim 1, wherein:

a) said connecting means includes means for slidably connecting said first end portion of said second support to said first support.

13. The hangar as recited in claim 12, wherein:

a) said length adjusting means for said first support includes generally tubular inner and outer members; and b) said inner member is telescopically adjustable with respect to said outer member.

14. The hangar as recited in claim 13, wherein:

a) each of said inner and outer members have generally non-circular cross sections for resisting torque.

15. The hangar as recited in claim 13, further including:

a) means for securing said inner member to said outer member.

16. The hangar as recited in claim 1, wherein:

a) said length adjusting means for said first support includes an inner member and an outer member and means provided on said inner and outer members for establishing a fixed length thereof and for guiding a user to form a counterpart fixed length establishing means on the other one of said inner and outer members.

17. The hangar as recited in claim 1, wherein:

a) said connecting means includes means for infinitely variably fixedly connecting said first end portion of said second support to said first support.

18. The hangar as recited in claim 1, wherein:

a) each of said inner and outer members of said first support have generally non-circular cross sections for resisting torque.

19. A hangar as recited in claim 1, wherein:

a) said template comprises a hole in said first member.

20. A ceiling fixture hangar, comprising:

a) an elongated first support having first and second end portions;

b) said first support having an infinitely variably fixed adjustable length;

c) said first support having first and second members infinitely adjustable relative to each other for adjusting the length of said first support;

d) a first bolt for fixing said first member relative to said second member;

e) an elongated second support having first and second end portions;

f) said second support having an adjustable length;

g) said second support having first and second members infinitely adjustable relative to each other for adjusting the length of said second support;

h) a second bolt for fixing said first and second members of said second support relative to each other;

i) at least one of said first and second bolts extending into both said first and second members of one of said first and second supports for infinitely variably fixedly adjusting the length of said one of said first and second supports;

j) a connecting member for slidably connecting said first end portion of said second support to said first support, intermediate said first and second end portions of said first support;

k) a respective first and second securing member for securing said first and second end portions of said first support with two spaced apart ceiling joists for supporting a vertical load; and l) a mounting member for mounting a fixture to said second end portion of said second support.

21. The hangar as recited in claim 20, wherein:

a) said connecting member includes a generally U-shaped bracket having an open end and a closed end;

b) said first support extends through said bracket and said closed end of said bracket substantially engages said first support;

c) at least one bolt extends through said U-shaped bracket and said second support; and d) at least one nut is secured to each of said bolts.

22. The hangar as recited in claim 20, wherein:

a) said securing member includes at least one bolt extending through each of said first and second and portions of said first support, and each of said bolts being securable to a ceiling joist.

23. The hangar as recited in claim 20, wherein:

a) said securing member includes a generally U-shaped wedge bracket removably attached to each of said first and second and portions of said first support member; and b) each of said wedge brackets being securely engagable with a ceiling joist.

24. A ceiling fixture hangar, comprising:

a) an elongated first support having first and second end portions;

b) said first support including a means for adjusting the length of said first support;

c) an elongated second support having first and second end portions;

d) said second support including a means for adjusting the length of said second support;

e) means for connecting said first end portion of said second support to said first support intermediate said first and second end portions of said first support;

f) means disposed adjacent said first support for securing said first and second end portions of said first support with two spaced apart ceiling joists for supporting a vertical load;

g) said first support length adjusting means including an inner and outer member movable relative to each other;

h) said length adjusting means for said first support including means provided on one of said inner and outer members for establishing a fixed length thereof and for guiding a user to form a counterpart fixed length establishing means on the other one of said inner and outer members;

i) said means for establishing a fixed length including a template on said outer member for guiding a user to drill a hole in said inner member; and j) means disposed adjacent said second support for mounting a fixture to said second end portion of said second support.

25. The hangar as recited in claim 24, wherein:

a) said length adjusting means for said first support includes generally tubular inner and outer members; and b) said inner member is telescopically adjustable with respect to said outer member.

26. The hangar as recited in claim 25, wherein:

a) each of said inner and outer members have generally non-circular cross sections for resisting torque.

27. A hangar as recited in claim 24, wherein:

a) said template comprises a hole in said first member.

28. A ceiling fixture hangar, comprising:

a) an elongated first support having first and second end portions;

b) said first support having an adjustable length;

c) an elongated second support having first and second end portions;

d) said second support having an adjustable length;

e) a connecting member for slidably connecting said first end portion of said second support to said first support, intermediate said first and second end portions of said first support;

f) a respective first and second securing member for securing said first and second end portions of said first support with two spaced apart ceiling joists for supporting a vertical load;

g) said first support including first and second members movable relative to each other for adjusting the length of said first support;

h) a template being provided on said first member for guiding a user to drill a hole in said second member;

i) a mounting member for mounting a fixture to said second end portion of said second support;

j) whereby, when said template has been used to guide a user to drill a hole in said second member, a fastener may be placed therethrough for fixing the location of the second member relative to said first member for fixing the length of said first support and for preventing movement of said second member both toward and away from said first member.

29. The hangar as recited in claim 28, wherein:

a) said first support includes generally tubular inner and outer members; and b) said inner member is slidably positioned coaxially within said outer member.

30. A hangar as recited in claim 28, wherein:

a) said template includes a hole.

31. A hangar as recited in claim 30, wherein:

a) said template includes said hole being in said first member.

32. A ceiling fixture hangar, comprising:

a) an elongated first support having first and second end portions;

b) said first support including a means for adjusting the length of said first support;

c) said length adjusting means for said first support includes generally tubular inner and outer members;

d) said length adjusting means for said first support including means provided on one of said inner and outer members for establishing an infinitely variably fixed length thereof and for guiding a user to form a counterpart fixed length establishing means on the other one of said inner and outer members;

e) each of said inner and outer members have generally non-circular cross sections for resisting torque;

f) an elongated second support having first and second end portions;

g) said second support including a means for adjusting the length of said second support;

h) means for slidably connecting said first end portion of said second support to said first support intermediate said first and second end portions of said first support;

i) means disposed adjacent said first support for securing said first and second end portions of said first support with two spaced apart ceiling joists for supporting a vertical load; and j) means disposed adjacent said second support for mounting a fixture to said second end portion of said second support.

33. The hangar as recited in claim 32, wherein:

a) said length adjusting means for said second support includes generally tubular inner and outer members.

34. A ceiling fixture hangar, comprising:

a) an elongated first support having first and second end portions;

b) said first support having an infinitely variably fixed length;

c) said first support includes generally tubular inner and outer members;

d) each of said inner and outer members of said first support have generally non-circular cross sections for resisting torque;

e) an elongated second support having first and second end portions;

f) said second support having an adjustable length;

g) a hole provided in said outer member, said hole being configured for guiding a user to drill a hole in said inner member of said first support for establishing said infinitely variably fixed length of said first support when a fastener is disposed in the respective holes in said inner and outer members;

h) a connecting member for slidably connecting said first end portion of said second support to said first support, intermediate said first and second end portions of said first support;

i) a securing member for securing said first and second end portions of said first support with two spaced apart ceiling joists for supporting a vertical load; and j) a mounting member for mounting a fixture to said second end portion of said second support.

35. The device as recited in claim 34, wherein:

a) said second support includes generally tubular inner and outer members; and b) said inner member is slidably positioned coaxially within said outer member.

36. The hangar as recited in claim 34, wherein:

a) said connecting member includes a generally U-shaped shaped bracket.

37. A ceiling fixture hangar, comprising:

a) an elongated first support having first and second end portions;

b) said first support including a means for infinitely variably fixedly adjusting the length of said first support;

c) an elongated second support having first and second end portions;

d) said second support including a means for infinitely variably fixedly adjusting the length of said second support;

e) means for fixedly connecting said first end portion of said second support to said first support intermediate said first and second end portions of said first support;

f) means disposed adjacent said first support for securing said first and second end portions of said first support with two spaced apart ceiling joists for supporting a vertical load;

g) means disposed adjacent said second support for mounting a fixture to said second end portion of said second support;

h) said connecting means including a generally U-shaped bracket having an open end and a closed end;

i) said first support extending through said U-shaped bracket, and said closed end of said U-shaped bracket substantially engaging said first support;

j) means disposed adjacent to said U-shaped bracket for releasably fastening said open end of said U-shaped bracket to said first end portion of said second support; and k) said fastening means including a nut and a bolt, said bolt extending through said U-shaped bracket and said second support, and said nut securing said bolt therein.

38. A ceiling fixture hangar, comprising:

a) an elongated first support having first and second end portions;

b) said first support including a means for infinitely variably fixedly adjusting the length of said first support;

c) an elongated second support having first and second end portions;

d) said second support including a means for infinitely variably fixedly adjusting the length of said second support;

e) means for fixedly connecting said first end portion of said second support to said first support intermediate said first and second end portions of said first support;

f) means disposed adjacent said first support for securing said first and second end portions of said first support with two spaced apart ceiling joists for supporting a vertical load;

g) means disposed adjacent said second support for mounting a fixture to said second end portion of said second support;

h) said fixture mounting means including a generally U-shaped bracket and a mounting plate;

i) said U-shaped bracket having an open end and a closed end;

j) said closed end of said bracket being positioned intermediate said mounting plate and said second end portion of said second support;

k) means disposed adjacent to said bracket for releasably fastening said open end of said bracket to said second end portion of said second support; and l) means disposed adjacent said closed end of said bracket for securing said mounting plate to said closed end of said bracket.

39. A ceiling fixture hangar, comprising:

a) an elongated first support having first and second end portions;

b) said first support having an infinitely variably fixed adjustable length;

c) said first support having first and second members infinitely adjustable relative to each other for adjusting the length of said first support;

d) a first bolt for fixing said first member relative to said second member;

e) an elongated second support having first and second end portions;

f) said second support having an adjustable length;

g) said second support having first and second members infinitely adjustable relative to each other for adjusting the length of said second support;

h) a second bolt for fixing said first and second members of said second support relative to each other;

i) a connecting member for slidably connecting said first end portion of said second support to said first support, intermediate said first and second end portions of said first support;

j) a respective first and second securing member for securing said first and second end portions of said first support with two spaced apart ceiling joists for supporting a vertical load;

k) a mounting member for mounting a fixture to said second end portion of said second support;

l) said connecting member including a generally U-shaped bracket having an open end and a closed end;

m) said first support extending through said bracket and said closed end of said bracket substantially engaging said first support;

n) at least one bolt extending through said U-shaped bracket and said second support; and o) at least one nut being secured to each of said bolts.

* * * * *